US005382562A

United States Patent [19]

Hutten

[11] Patent Number: 5,382,562

[45] Date of Patent: Jan. 17, 1995

[54] ERASABLE MARKER-BOARD HAVING PERMANENT INFORMATION IMMOBILIZED IN ITS ERASABLE POLYMERIC SURFACE AND METHOD OF MAKING

[75] Inventor: James E. Hutten, Mason, Ohio

[73] Assignee: Ghent Manufacturing, Inc., Lebanon, Ohio

[21] Appl. No.: 176,317

[22] Filed: Jan. 3, 1994

Related U.S. Application Data

[63] Continuation of Ser. No. 760,330, Sep. 16, 1991, abandoned.

[51] Int. Cl.[6] ..... B41M 5/20

[52] U.S. Cl. ..... 503/227; 428/195; 428/913; 428/914

[58] Field of Search ..... 428/195, 43, 141, 35.1, 428/207, 321.3, 913, 914; 229/303; 283/2; 446/151; 503/227

[56] References Cited

U.S. PATENT DOCUMENTS 4,775,657 10/1988 Harrison et al. ..... 428/195

4,988,123 1/1991 Lin et al. ..... 428/321.3

*Primary Examiner*—Patrick J. Ryan

*Assistant Examiner*—William A. Krynski

*Attorney, Agent, or Firm*—Wood, Herron & Evans

[57] ABSTRACT

Erasable markerboards are disclosed having permanent information immobilized in its erasable polymeric surface. The markerboards are suitable for receiving erasable liquid ink images that are removable by eraser means without any residual ghost of the image remaining on the marking surface. The permanent information is sublimed into and extends below the marking surface and is unaffected by erasable inks and eraser means to which the marking surface would normally be subjected in use.

5 Claims, 1 Drawing Sheet

ERASABLE MARKER-BOARD HAVING PERMANENT INFORMATION IMMOBILIZED IN ITS ERASABLE POLYMERIC SURFACE AND METHOD OF MAKING

This application is a continuation, of application Ser. No. 760,330, filed Sep. 16, 1991, now abandoned.

BACKGROUND OF THE INVENTION

Erasable markerboards and other erasable marker surfaces are well known. Typically, these markerboards and surfaces have been made of durable polymeric materials or plastics that can withstand being printed upon usually with erasable liquid inks and then reused after removal of the ink images. The marker surface must be impermeable or nonreactive so as not to permanently receive the ink image. Otherwise, the markerboard surface would not be erasable and reusable, thus defeating its purpose.

In many instances, it is desirable to print permanent information or indicia on the markerboard surface such as charted lines, numbers, words or other markings. The objective of such permanent information is to provide a format or background on which the erasable ink images are to be placed. Then, after the erasable ink images are printed on the surface and erased, the permanent information remains on the surface for reuse as the format or background. For instance, calendars, monthly planners, bulletin boards, personnel status boards, and many other information boards desirably have permanent information on them to serve as background for the erasable ink images.

Difficulties have been encountered in making durable marker surfaces with permanent background indicia. Heretofore for many years, printing or silk screen techniques have been employed to place somewhat permanent background indicia on the marker surface. It has been found, however, that such indicia do not wear well and, as the board is continuously used and erased, the indicia will fade, be rubbed off or distorted. Furthermore, bonding and clarity of permanent indicia on the marking surface has not been satisfactorily achieved. For many years, silk screen techniques have been employed to impart a pattern indicia upon markerboard surfaces. The desirable feature of a durable or nonreactive surface for temporarily receiving the ink image on the silk-screened markerboard usually diminishes the life of the permanent background indicia. It has become exceedingly difficult to obtain a durable silk-screened or other image of a permanent nature on a markerboard that has the desirable characteristics of erasability of ink images.

There is a need for a markerboard having a surface for receiving erasable ink images and a permanent background or indicia that can withstand continuous use and erasing means so that the ink images may be removed and the board reused.

SUMMARY OF THE INVENTION

This invention is directed to an erasable markerboard. The markerboard has a polymeric marking surface for receiving erasable ink images. The polymeric surface accepts liquid ink images that may be removed by eraser means, such as a soft cloth or the like, without any residual ghost of said image remaining on the surface. The polymeric surface has a permanent indicia embedded into and extending below the marking surface. The permanent information or indicia is immobilized and the marking surface unaffected by the erasable inks and eraser means to which the surface would normally be subjected in use.

In a preferred form, the markerboard is made of a composition board having a thermoset resin surface that is capable of receiving information sublimed into and extending below the marking surface. The sublimed information is permanently embedded in the polymeric surface. The preferred thermoset polymer is an alkyd-melamine resin containing a white pigment such as titanium dioxide. Sublimable coloring agents and dyestuffs may be employed to impart the permanent sublimed image in the polymeric surface.

A method for making an erasable markerboard having the permanent image embedded therein involves bringing a rigid panel formed of a reinforcing backing board having an alkyd-melamine resin surface containing a white pigment to provide a contrasting background for temporary liquid ink images. A transfer sheet containing the information or image to be imparted in the form of sublimable dyestuffs is placed in direct contact with the polymeric surface. By applying heat and light pressure to the transfer sheet and rigid panel in order to maintain intimate contact between their surfaces, the dyestuff of the image is caused to sublimate and penetrate into the polymeric markerboard surface. Thereafter, the transfer sheet is removed from the surface and the markerboard having a permanent background indicia and erasable surface is provided.

These and other objectives and advantages of this invention will be further understood with reference to the following detailed description.

DETAILED DESCRIPTION

Figure 1:
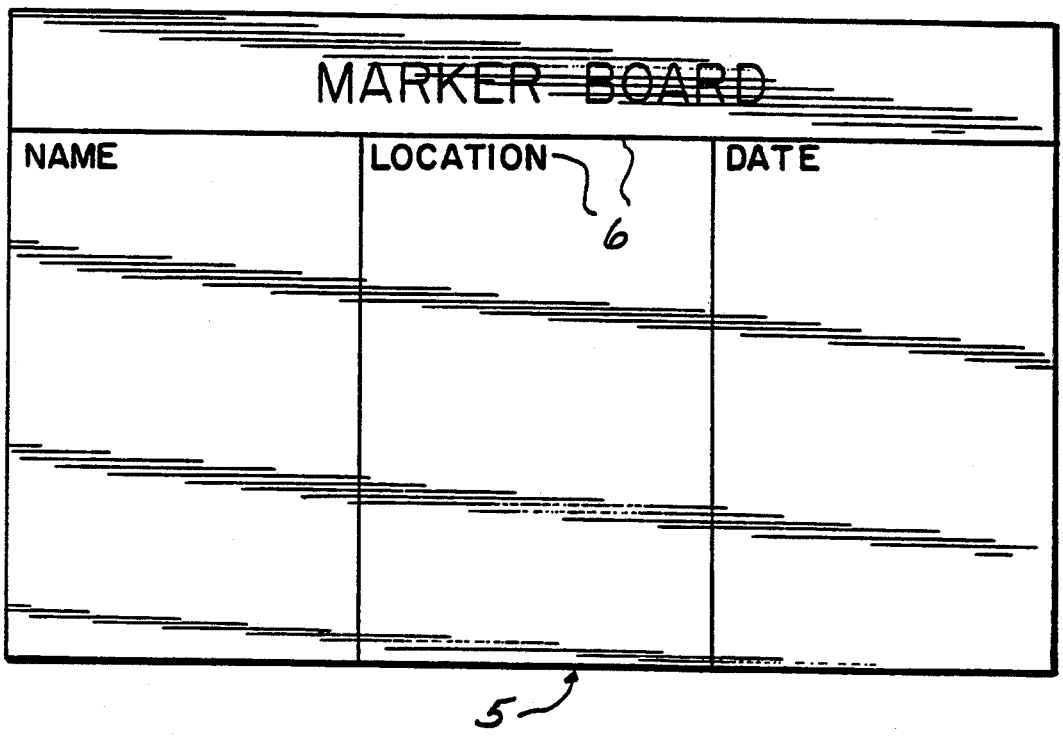
Figure 2:
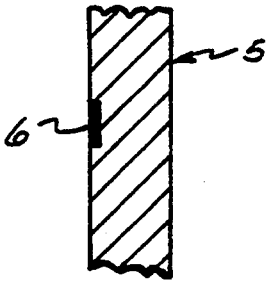

FIG. 1 is a front view of an erasable markerboard made in accordance with the principles of this invention, and FIG. 2 is a diagrammatic cross-sectional view of the markerboard along a line showing the permanent information of FIG. 1 sublimed into and extending below the marking surface.

FIG. 1 shows a typical erasable markerboard 5 made in accordance with the principles of the present invention. More particularly, the markerboard is formed by bringing a rigid panel having an alkyd-melamine resin surface in a white pigment to provide a contrasting background for liquid ink images to be temporarily imparted thereon. A transfer sheet containing the information or image to be imparted in the form of sublimable dyestuffs or coloring agents is placed in direct contact with the polymeric surface. By applying heat and light pressure to the transfer sheet and rigid panel in order to maintain intimate contact between their surfaces, the dyestuff of the image 6 is caused to sublimate and penetrate into the polymeric markerboard surface as shown by FIG. 2. Thereafter, the transfer sheet is removed from the surface and the markerboard having a permanent background indicia and erasable surface is provided.

Heat transfer sublimation printing processes have long been developed in the art. These processes may be employed to make markerboards suitable for use in accordance with the principles of this invention. For example, U.S. Pat. Nos. 4,121,897; 4,354,851 and 4,395,263 are examples of patents disclosing heat transfer sublimation printing processes. Their disclosures are incorporated herein by reference. Other polymeric surfaces including polyester, alkyd resin and acrylic polymer surfaces may be used as the markerboard or marker surface. Other pigments may be used or fillers such as clay, and calcium carbonate. Many subliminable inks may form the permanent image. Although such sublimation processes are known, it has not been heretofore suggested that such processes may be utilized to obviate the difficulties of the markerboard industry where, as indicated above, decades of problems have existed without satisfactory solution providing a markerboard for use with erasable inks that will satisfactorily work and yet the background images may be permanently imparted. This invention, thus, has fulfilled an outstanding need in the industry.

Having described this invention and its advantages and objectives, other modifications will become apparent without departing from its scope.

What is claimed is:

1. A method for making and erasing ink images on a markerboard comprising providing an erasable markerboard having a polymeric marking surface for receiving erasable ink images, said polymeric surface having permanent indicia sublimed into and extending below said marking surface, imaging said marking surface with an erasable ink image, removing said image with an eraser means without any residual ghost of said ink image remaining on said surface, said permanent indicia unaffected by said ink and eraser means to which said surface has been subjected whereby said markerboard may be reused.

2. The method of claim 1 wherein said permanent indicia is formed by sublimation of dyestuff into said polymeric surface.

3. The method of claim 2 wherein said polymeric surface is selected from the group consisting of alkyd-melamine resins, polyester resins, alkyd resins and acrylic polymers.

4. The method of claim 1 wherein said polymeric surface is an alkyd-melamine resin containing pigment to serve as contrasting background for the embedded permanent indicia.

5. The method of claim 4 wherein said pigment is a white pigment.

* * * * *